US005100134A

United States Patent [19]

Becker

[11] Patent Number: 5,100,134

[45] Date of Patent: Mar. 31, 1992

[54] BALL SUPPORT DEVICE

[75] Inventor: Roland Becker, Tahoe City, Calif.

[73] Assignee: Aviva Sport, Inc., San Francisco, Calif.

[21] Appl. No.: 425,122

[22] Filed: Oct. 23, 1989

[51] Int. Cl.[5] ..... A63B 69/40

[52] U.S. Cl. ..... 273/26 R; 273/29 A

[58] Field of Search ..... 273/26 R, 29 A, 207; 248/519–528, 117.2, 441.1; 47/39; 272/76, 77, 78

[56] References Cited

U.S. PATENT DOCUMENTS

| | | | |
|---|---|---|---|
| 1,020,367 | 3/1912 | Patterson, Jr. | 272/78 |
| 1,463,734 | 7/1923 | Ullrich | 248/524 |
| 2,186,403 | 1/1940 | Bullis et al. | 272/78 |
| 2,189,687 | 2/1940 | Thomas | 248/523 |
| 2,976,041 | 3/1961 | White | 273/26 R |
| 3,022,072 | 2/1962 | Zinnow | 272/78 |
| 3,039,770 | 6/1962 | Ferretti | 273/26 R |
| 3,139,282 | 6/1964 | Lande | 273/26 R |
| 3,489,411 | 1/1970 | Morelli et al. | 273/26 R |
| 4,105,204 | 8/1976 | Koenig | 273/29 A |
| 4,681,318 | 7/1987 | Lay | 273/26 R |

FOREIGN PATENT DOCUMENTS

| | | | |
|---|---|---|---|
| 318719 | 9/1929 | United Kingdom | 272/78 |

*Primary Examiner*—Theatrice Brown
*Attorney, Agent, or Firm*—Townsend & Townsend

[57] ABSTRACT

A ball support device is used for supporting a ball at an elevated position so that the ball can be struck while so supported with a bat, club or like sports implement. The ball support device includes a base, a post and a ball holder fitted to the upper end of the post. The post is formed from two telescopically interconnected members, and a friction grip means is provided for fixing the two members relative to each other at a selected height. The holder may itself be flexible and the connection between the base and the post is preferably resiliently flexible so that an articulated connection between post and base is achieved, and the post is biased to its operatively vertical orientation. The components are preferably all easily disengagable from each other so that the device can be erected and disassembled without difficulty.

4 Claims, 2 Drawing Sheets

BALL SUPPORT DEVICE

INTRODUCTION

This invention relates to a ball support device for holding a ball stationary in an elevated position in order that it may be struck by a sports implement such as a bat, club or the like. The invention will be described with particular reference to a tee for supporting a baseball in position to enable the ball to be struck by a baseball bat, but it will be understood that the invention has wider application.

BACKGROUND OF THE INVENTION

Ball support devices of the aforementioned type are known and comprise a support post which is adapted to be embedded in the ground or otherwise supported by a base so as to extend vertically upwards. The upper end of the post has a cup or dish shaped member thereon which provides an upwardly facing concave surface in which the ball to be struck can be located. Devices of this nature are used to play various games and are used as training aids for young players who are not sufficiently well coordinated to play conventional baseball where the ball is thrown towards the batsman.

Prior art devices of this nature have suffered from various disadvantages. One disadvantage concerns the flexibility of the device. Generally such devices comprise a rigid post which may have the upper end thereof covered by a resilient cover or the like. However, when the cover is struck by a bat a substantial impact force is imparted to the post potentially causing damage to the post or bat and tending to knock the post over. A further problem with many prior art devices is that they are not adjustable in height, or are only adjustable with difficulty making the device unsuitable for use by a range of sizes of players in the same game.

A yet further problem with many prior art devices is that they are not easily packaged for sale and transportation. Clearly if the device is provided with a base which is heavy, or where the device is bulky, transportation costs are increased.

An object of this invention is to provide a ball support device which is easily adjustable, and which is less susceptible to damage than at least some prior art devices. A further object is to provide a ball support device which is easily assembled and disassembled and which is relatively compact when disassembled.

SUMMARY OF THE INVENTION

A ball support device according to the invention has several characterising features, and not all of those features need be included in a device in order to obtain benefit from the invention. One of the characterising features is that the support device includes a support post comprised of two telescopically interconnected members slidable relative to each other and a friction grip means for holding the two members in a desired position of adjustment to thereby provide means for adjusting the height of the post. A further characterising feature is that the post has a tubular shaped ball holder fitted to the upper end thereof, the ball holder having a variable flexural rigidity along its length, the ball holder being telescopically slidable on the upper end of the post. A yet further characterising feature is that the lower end of the post is connected to a base and the base is formed of at least one flexible strut which allows the post to tilt relative to the surface on which the device is located. A further feature is to provide a flexible connection between the base and the post and for the degree of flexural rigidity of the connection to be variable as required. Other characterising features of the invention will become apparent from the following description of one example embodiment of the invention.

BRIEF DESCRIPTION OF THE DRAWINGS

Two embodiments of the invention will now be described by way of examples with reference to the accompanying drawings.

In the drawings.

DETAILED DESCRIPTION OF PREFERRED EMBODIMENTS

Figure 1:
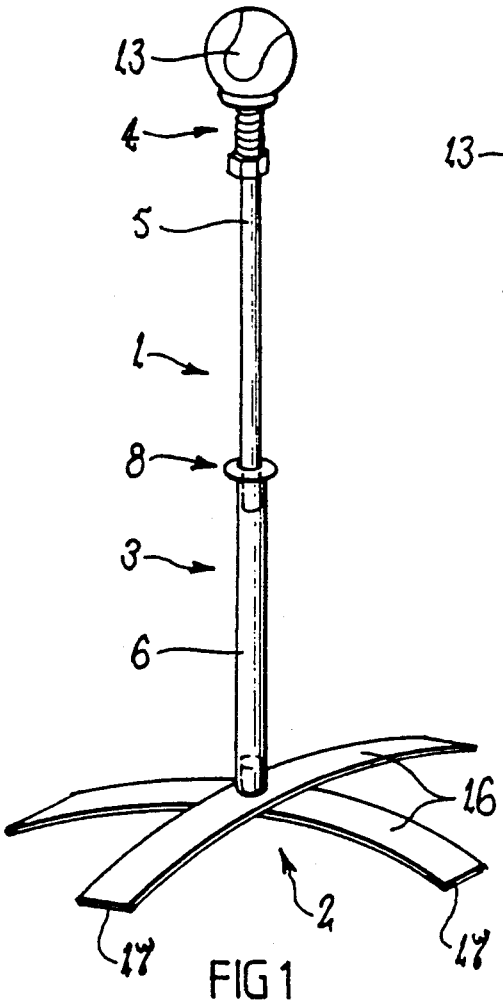
FIG. 1 shows a perspective view of a ball support device according to the invention.
Figure 2:
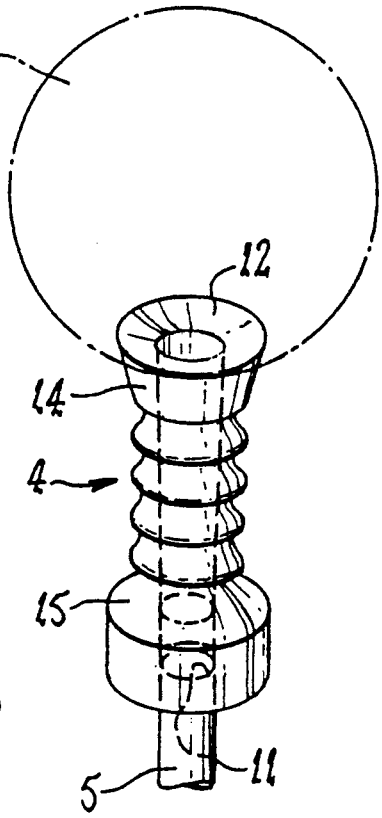
FIG. 2 shows an enlarged perspective view of a holder for the device of FIG. 1, FIGS. 3*a* and *b* show perspective and cross-sectional views respectively of a friction grip ring.

Referring initially to FIGS. 1 to 4 the ball support device 1 includes a base 2, a support post 3, and a tubular ball holder 4 fitted to the top of the support post. The support post 3 may be comprised of upper and lower tubular members, numbered 5 and 6 respectively, the upper member 5 being of smaller diameter than the lower member 6. The upper member 5 is preferably a close sliding fit within the internal bore 7 of the lower member so that the height of the post 3 can be varied by moving the upper member 5 into or out of the lower member 6 to decrease or increase the height of the post 3 respectively. The tubular members 5,6 may be formed of a light-weight plastics material which is sufficiently strong to withstand the rigours of being struck by a bat under normal game playing conditions.

Figures 3A, 3B, 5:
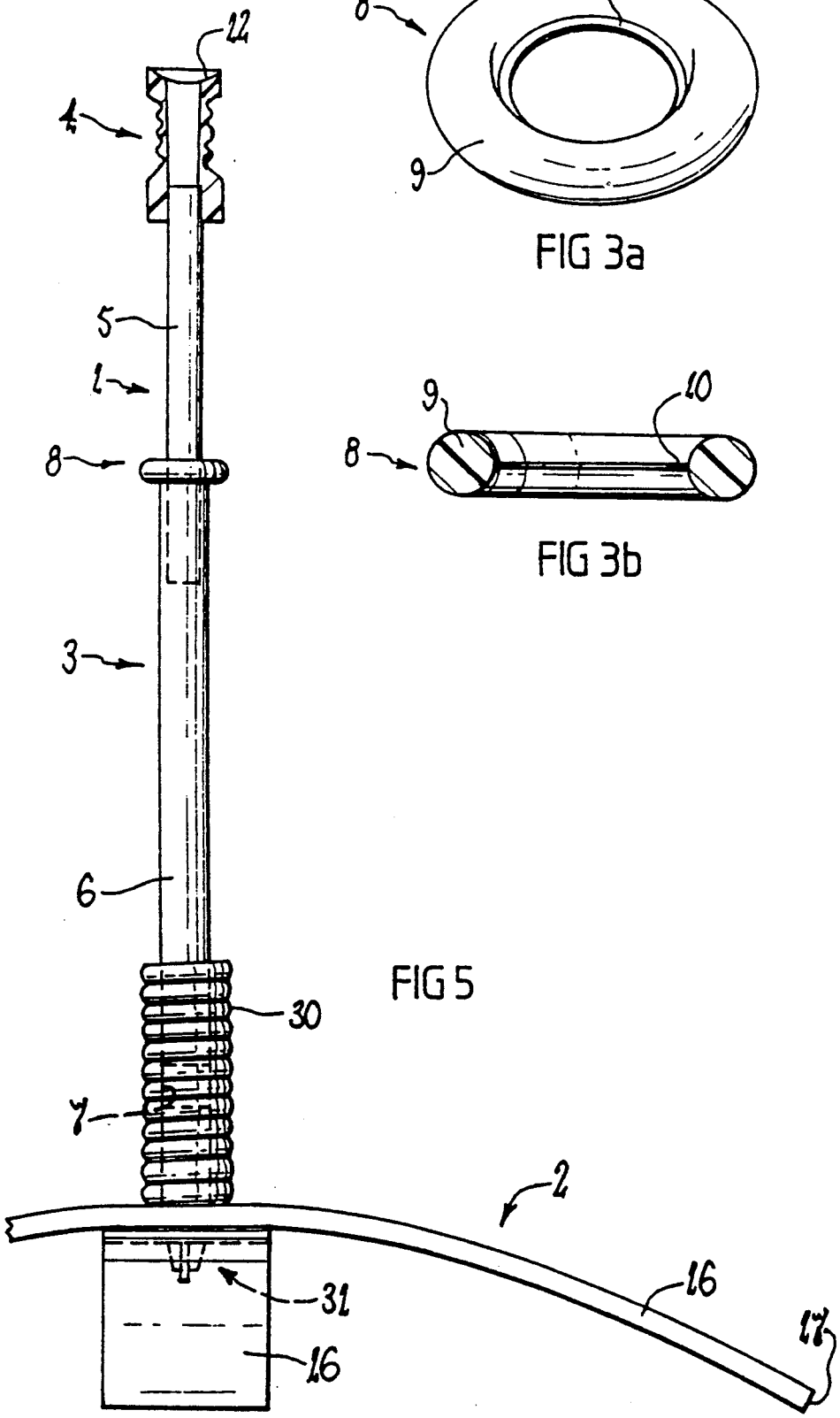
FIG. 5 shows a side view of an alternative embodiment of ball support device according to the invention.

There is preferably a friction grip means 8 for holding the two tubular members 5 and 6 in any position of height adjustment. That friction grip means 8 may take various forms but one convenient form as shown in FIGS. 3*a* and 3*b* is a slip ring 9 formed of rubber or the like which is a relatively tight grip around the upper tubular member 5 but is slidable relative to the upper tubular member 5 so as to vary the position of the ring 9 along the length of that tubular member 5. The slip ring 9 may be in the form of an O-ring having a flexible flange 10 formed around the inner periphery thereof, the flange 10 serving to improve the grip between the ring 9 and the upper tubular member 5. Clearly, the ring 9 will not fit in the annular space between the upper and lower tubular members 5 and 6 so that the extent to which the upper tubular member 5 can slide into the lower tubular member 6 will be limited by the position of the ring 9.

The ball holder 4 can take any convenient form but is preferably tubular having an internal diameter which is a sliding fit on the upper end 11 of the upper tubular member 5. The ball holder 4 will have an upper surface 12 of concave shape having a radius of curvature suitable to accommodate the ball 13 to be located therein. The flexural rigidity of the ball holder may vary along its length, preferably being more flexible at the upper end 14 thereof than the lower end 15. This may be achieved by varying the wall thickness of the holder 4, or by varying the density of the material from which the holder is made along its length. Optionally the outer , surface 16, of the ball holder 4, may have a ribbed surface. The holder 4 may be formed of a foamed plastic material.

The position of .the holder 4 on the upper tubular member 5 can be varied, and this may be desirable where for example, a heavier ball 13 is to be used and the player is more skilled, by sliding the holder 4 down the upper tubular member 5 to thereby increase the rigidity of the holder 4 and to provide better support for the heavier ball 13. Clearly, where a significant length of holder 4 extends above the upper end 11 of the upper tubular member 5 the flexible nature of the holder will ensure that, where it is only the holder that is struck during play, the holder will simply flex with the bat placing minimal impact load on the post 3.

The support post 3 may itself be provided with a base 2 which is flexible. In a preferred form of the invention the base comprises a pair of curved plate like struts 16 joined together about their centres and to the support post 3. The struts 16 which comprise the base may curve in a direction away from the support post 3 such that the ends 17 of the struts 16 contact the ground on which the device is to be located and the post 3 extends vertically upward therefrom. The struts 16 thus provide a four contact point support for the device 1. Where the struts 16 are flexible, a tilting of the support post may cause a flexing in the struts 16 thereby providing an additional facility for absorbing lateral impact loads in use. The struts 16 are preferably widely splayed providing a large diameter stable base for the device 1 which can be used on hard or impenetrable ground. The base struts 16 may themselves be formed of a plastics material which is light-weight and therefore easily packaged and transported. The base struts 16 are preferably separable and the means 18 for connecting the struts together also preferably connects the support post 3 to the struts 16. As mentioned, the configuration of base 2 referred to above is advantageous since it provides a stable platform for the device 1 and is flexible so as to be able to accommodate considerable lateral movement of the support post 3 without tipping over or breaking. The base 2 as described can be used even where the ground is uneven and may if necessary be more securely anchored to the ground by weighing it down by placing weights, (not shown) such as sand bags, on the struts 16.

Figure 4:
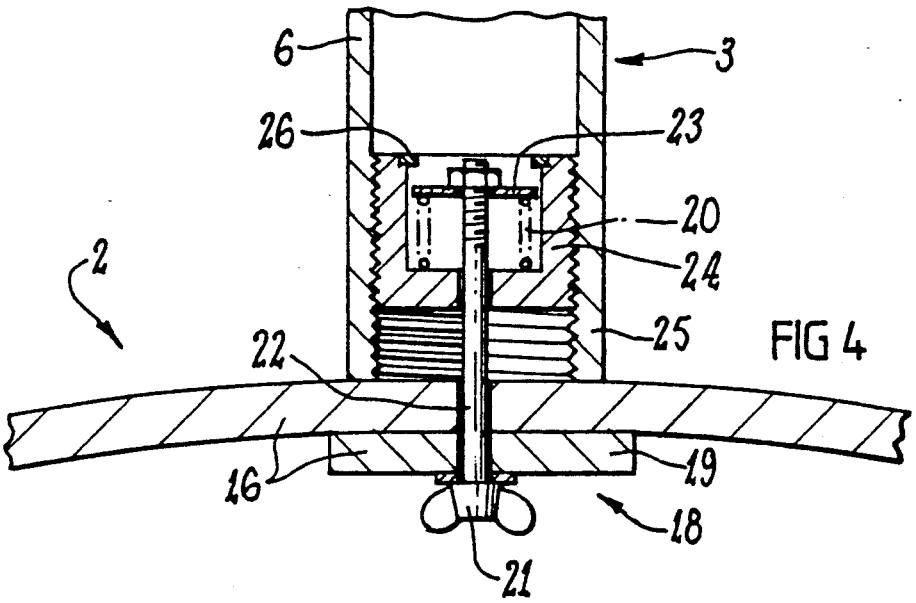
FIG. 4 shows a side view of the lower portion of the support device shown in FIG. 1.

The post 3 may be connected to the base 2 by any convenient means but it is preferred that the connection means 18 is itself flexible. A resilient spring 20 as shown in FIG. 4 may be incorporated into the connection 18. The connection 18 includes a bolt 19 with finger engagable wings 21 and a shank 22 which is arranged to screw into a nut 23 located within a retaining cup 24 secured into the lower end 25 of the lower tubular member 6. The cup may be screwed or adhered into the tubular member as shown. The nut 23 is slidable within the cup 24 and is retained in the cup by a circlip 26. It will be appreciated from the drawing that the post 3 is able to tilt relative to the base 2 by compressing the spring 20. The degree of tilt will be limited by the extent to which the spring 20 is able to compress. Thus, by screwing the bolt 19 tightly into the nut 23 the post will be more rigidly connected to the base, and the extent to which the post 3 can be tilted relative to the base 2 will be limited. If the bolt 19 is screwed into the nut 23 to a lesser extent the post 3 will be able to tilt relative to the base 2 to a greater extent and the resistance to tilting will be less. The spring 20 serves to bias the post 3 to a vertical position.

An alternative connection arrangement as shown in FIG. 5 provides a tubular socket 30 of resiliently flexible material which is fixed to the base by a bolt 31 or other fastening means. The axis of the socket 30 will extend vertically so that the support post 3 may be located therein to be supported on the base 2. The lower end 25 of the post 3 ; is preferably a sliding fit within the socket 30 so that the height of the post can be varied by adjusting the extent to which the post 3 is pushed into the socket 30. Also, the socket 30 may be formed of a resiliently flexible material so that the post 3 can pivot relative to the base by flexing the socket 30. The flexural rigidity of the connection will thus be varied by the extent to which the relatively rigid post is inserted into the socket 30.

Clearly, assembly and disassembly of the device will be a simple matter since most components are simply a sliding fit connection and can be separated without difficulty. The connection of the base members may be made as a similar sliding fit or may be in the form of a finger tightening screw or bolt member as described. All of the components may be made of suitable plastics material of a strength concomitant to the loads which will be placed thereon in use, and the degree of flexural rigidity required.

It is to be understood that various alterations, modifications and/or additions may be introduced into the constructions and arrangements of parts previously described without departing from the spirit or ambit of the invention.

Having now described my invention what I claim as new and desire to secure by letters patent is:

1. A ball support device for supporting a ball in an elevated position to enable the ball thus supported to be struck with a sports implement in use, said device comprising:

a post comprising a lesser diameter member and a larger diameter member telescopically interconnected and made slidable relative to each other to provide an arrangement for varying the length of the post;

a base for supporting the post vertically, said base comprising a pair of resiliently flexible struts operatively connected together at their centers and aligned transverse to each other, and a connector which holds the struts together and which connects the struts to the operatively lower end of said post;

a friction grip means in contact with each of said members for holding the members in a selected position of telescopic adjustment, said friction grip comprising an elastomeric ring which fits tightly around said lesser diameter member, and restricts movement of said lesser diameter member into said larger diameter member; and a ball holder on the operatively upper end of the post in which a ball to be struck can be placed in use, said ball holder comprising a flexible tubular member formed of a resilient foamed plastics material and having a central hollow channel along its longitudinal axis configured to receive and frictionally engage said upper end of said post, the degree of engagement between said upper end of said post and said ball holder being variable to thereby provide an arrangement for varying the length of said flexible tubular member extending above said upper end of said post, said flexible tubular member further configured having a varying flexural rigidity along its length with the greater flexural rigidity being towards the operatively lower end of the holder and the lesser flexural rigidity being towards the operatively upper end of the holder.

2. A ball support device according to claim 1 wherein the struts are each substantially arcuate form, the post being connected to the convex side thereof.

3. A ball support device according to claim 1 wherein the varying flexural rigidity of said flexible tubular member is at least partially provided by varying the thickness of the foamed plastics material along the length of the flexible tubular member.

4. A ball support device according to claim 1 wherein said ball holder further comprises a concave upper surface having a radius of curvature suitable to accommodate a ball.

* * * * *